United States Patent [19]

Wormly

[11] 4,407,459

[45] Oct. 4, 1983

[54] TOILET PAPER STORAGE DISPENSER

[76] Inventor: Thaddaues H. Wormly, 1218-20 Liberty St., Camden, N.J. 08104

[21] Appl. No.: 307,656

[22] Filed: Oct. 2, 1981

Related U.S. Application Data

[63] Continuation-in-part of Ser. No. 204,217, Nov. 5, 1980, Pat. No. 4,322,042.

[51] Int. Cl.[3] ..... B65H 19/00

[52] U.S. Cl. ..... 242/55.53; 242/55.3

[58] Field of Search ..... 242/55.2, 55.3, 55.53, 242/55.54; 312/38–40; 225/33, 46, 47, 54, 67, 88

[56] References Cited

U.S. PATENT DOCUMENTS

| | | | |
|---|---|---|---|
| 3,790,097 | 2/1974 | Wormly | 242/55.53 |
| 3,806,057 | 4/1974 | Whatley | 242/55.54 |
| 4,034,929 | 7/1977 | Ebner, Jr. | 242/71.1 |
| 4,322,042 | 3/1982 | Wormly | 242/55.54 |

*Primary Examiner*—Leonard D. Christian

*Attorney, Agent, or Firm*—Robert K. Youtie

[57] ABSTRACT

A storage dispenser for toilet paper comprising an open ended enclosure including a central guide member about which paper rolls are circumposed and guided along between inlet and outlet ends of the enclosure, the guide having one end free at the inlet of the enclosure and having its other end connected to the enclosure; an end wall across the inlet end of the enclosure in detachable interfitting engagement with the free end of the guide; and slide means mounting the end wall slidably to the enclosure for movement of the end wall away from and toward the inlet enclosure end and out of and into interfitting engagement with the free guide end.

12 Claims, 5 Drawing Figures

10
11
12
13
14
20
35
37
38
39
40
50
51
52
53
54
55
56
57
58
59
65
66
67
68
70
71
72
73
74
75
80
81
83
4
5

67
68
70
73
75

TOILET PAPER STORAGE DISPENSER

CROSS-REFERENCES TO RELATED APPLICATIONS

This application is a Continuation-In-Part application of my copending U.S. patent application Ser. No. 204,217 filed Nov. 5, 1980 now U.S. Pat. No. 4,322,042.

BACKGROUND OF THE INVENTION

In the equipping of commercial and public restrooms with toilet paper storage dispensers, there are often problems of space, mainentance, security and cost. Sometimes space limitations require a toilet paper storage dispenser to be of either horizontal or vertical orientation. Security includes problems of pilferage in theft of toilet paper, and vandalism in destruction of the paper and dispenser. Maintenance includes ease of maintaining cleanliness and operability, as well as ample storage capacity to reduce the frequency of visits for replenishment of supply. This invention is an improvement over that of my U.S. Pat. No. 3,790,097, which is the closest known prior art.

SUMMARY OF THE INVENTION

It is among the objects of the present invention to provide a toilet paper storage dispenser which may selectively be oriented either horizontally or vertically to accomodate to all possible mounting requirements; protectively stores at least two toilet paper rolls in addition to a third roll being dispensed, and wherein the rolls may be of 1000 sheets, 1500 sheets or 1800 sheets, as desired; to provide a simple and extremely durable structure for extreme ease of sanitation, great resistance to damage, and reasonable cost in manufacture, distribution and installation.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

DESCRIPTION OF THE PREFERRED EMBODIMENT

Figure 1:
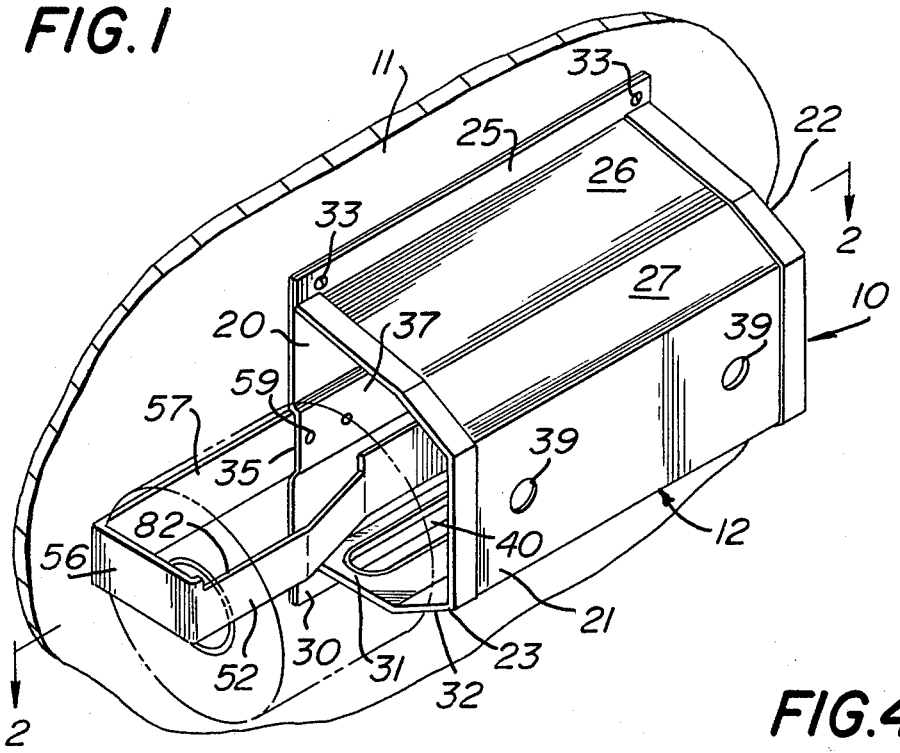
FIG. 1 is a perspective view showing a toilet paper storage dispenser of the present invention in an operative condition of use mounted generally horizontally on a vertical supporting wall, a toilet paper roll being shown in phantom.
Figure 2:
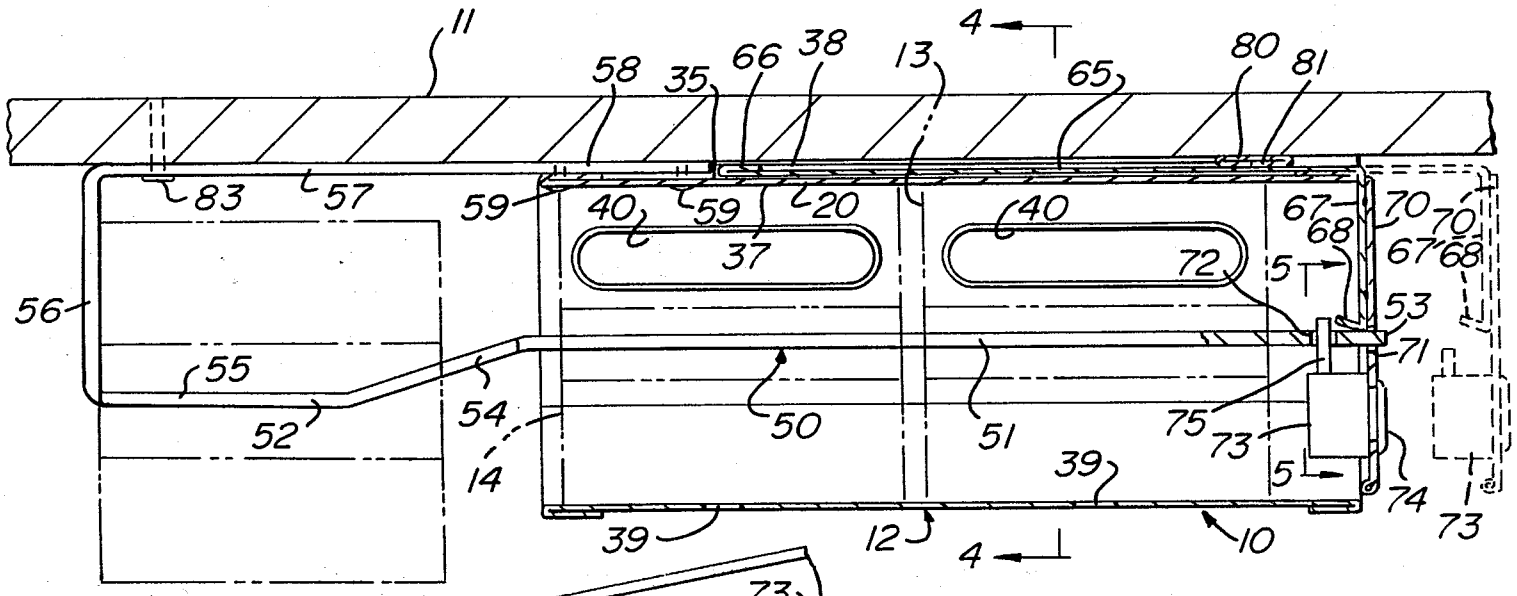
FIG. 2 is a generally horizontal, longitudinal sectional view taken generally along the line 2—2 of FIG. 1, and illustrating toilet paper rolls in phantom, and an open dispenser condition in dashed outline.
Figure 5:
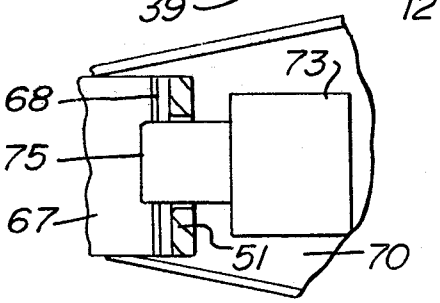
FIG. 5 is a partial sectional view taken generally along the line 5—5 of FIG. 2.

Referring now more particularly to the drawings, and specifically to FIGS. 1 and 2 thereof, a toilet paper roll dispenser is there generally designated 10, and arranged in generally horizontal relation for mounting on a vertical supporting surface or wall 11, as in a commercial or public restroom. The storage dispenser 10 includes a horizontally elongate housing or enclosure 12 for containing supply rolls 13 and 14 in storage, see FIG. 2.

The housing or enclosure 12 may include a generally rectangular, generally flat back wall 20 for securement in facing engagement with the vertical supporting surface or building wall 11. In addition to the generally rectangular, vertical back wall 20, the enclosure 12 includes a generally rectangular, vertical front wall 21 parallel and spaced outwardly from the back wall, and a pair of upper and lower side wall 22 and 23 extending between the back and front walls 20 and 21. The opposite ends of the enclosure 12 may be open.

The front wall 21 may be of less vertical extent than the back wall 20; and, the upper side wall 22 may decline forwardly between the upper regions of the back and front walls, while the lower side wall 23 may extend generally horizontally between the lower regions of the back and front walls. More specifically, the upper side wall 22 may include a rear edge flange 25 in facing engagement with the upper margin of the back wall 20, a forwardly declining main panel 26 extending forwardly from the lower edge of the flange 25, and a forward panel 27 declining from the forward edge of the main panel 26 to the upper edge of the front wall 21. The lower side wall 23 may be composed of a rear flange 30 in facing engagement with the lower margin of the back wall 20, from the upper edge of which extends a generally rectangular, forwardly extending horizontal panel 31, and a forward panel 32 extending forwardly and upwardly from the forward edge of the main panel 31 to the lower edge of the front panel 21. Suitable fastener means, as at 33 may extend through the overlying upper side wall flange 25 and upper margin of the back wall 20; and similar fastener means 34 may extend through the overlying lower side wall flange 30 at the lower margin of the back wall. If desired, the open end edges of the enclosure walls may be externally rolled or folded over, or otherwise finished as desired, to facilitate unimpeded roll movement through the enclosure.

Figure 4:
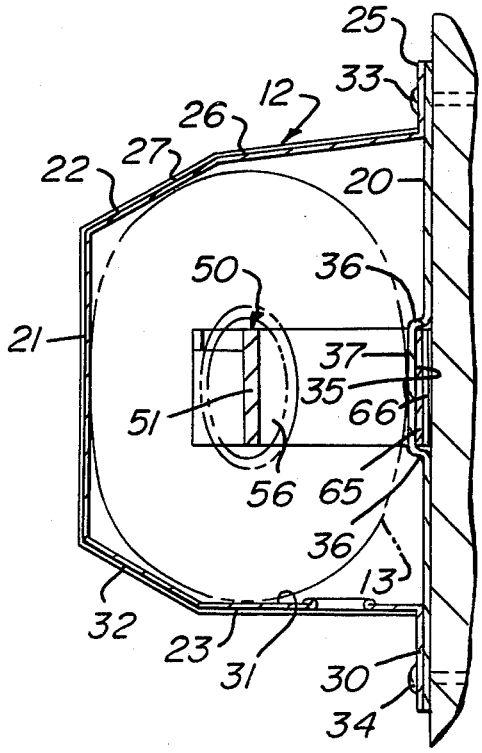
FIG. 4 is a transverse sectional view taken generally along the line 4 4 of FIG. 2.
Figure 3:
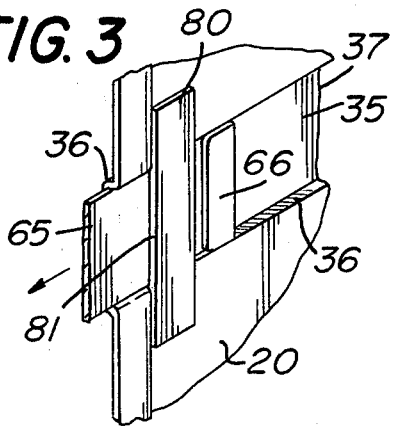
FIG. 3 is a partial rear perspective view of the instant storage dispenser.

As best seen in FIG. 4, the upper side wall 22 includes no horizontal surface, and therefore cannot readily support any undesired articles or material at rest. This facilitates sanitation.

The back wall 20 may be formed on its outer side, facing the supporting surface 11, with a groove 35 extending longitudinally of the enclosure 12. More particularly, the back wall 20 may be of sheet metal, being formed with a pair of parallel, longitudinally extending shoulders 36, extending transversely into the interior of the enclosure 12 and longitudinally coextensive with the back wall, and a bridging portion or web 37 extending between the inner regions of the shoulders and also longitudinally coextensive with the back wall. Thus, the groove 35 opens at opposite ends from the back wall 20, and in the mounted condition illustrated combines with the supporting vertical surface 11 to define with the latter an open ended passageway or tunnel 38.

The front wall 21 is additionally formed with one or more inspection openings or holes, as at 39, affording visual access to the enclosure interior for ascertaining need for additional toilet paper rolls. Also, one of the side walls, say the lower side wall 23, may be provided with one or more through openings, as at 40 in FIG. 2, affording manual access by a user for feeding rolls 13 and 14 leftward, for a purpose appearing presently. The view holes 39 and feed openings 40 may have smooth edges, as by rolling or curling, if desired.

Disposed generally centrally is spaced relation within the enclosure 12 is an elongate member, bar or toilet roll guide 50, which may be formed of bar stock, or other suitable material. The guide 50 includes a generally horizontal, storage portion 51 within the enclosure or housing 12. Extending integrally from the storage portion 51, the guide may include a dispensing portion 52 exteriorally of the enclosure and leftward thereof as seen in FIGS. 1 and 2. At the rightward, as seen in FIG. 2, the guide storage portion 51 terminates in an end 53 slightly outward beyond the rightward end of the enclosure. The storage portion 51 of guide 50 is disposed generally medially between the back enclosure wall 20 and the front enclosure wall 21; and the dispensing guide portion 52 extends from the leftward open end of the enclosure obliquely, as at 54, away from the plane of the back wall 20 to an outwardly offset portion 55 generally parallel to the plane of the back wall.

Extending integrally from the distal end of the dispensing guide portion 52, generally laterally thereof toward the supporting wall 11, is a lateral extension 56 which terminates at the supporting wall, generally in the plane of the enclosure back wall 20. An integral connector or bar portion 57 extends from the inner end of lateral extension 76 proximate to the supporting wall 11 into the adjacent open end of passageway 38 defined by groove 37. The end portion 58 of connector 57 extends into the adjacent open end groove 37 and terminates adjacent to and spaced inwardly from the open groove end, being suitably fixed therein as by rivets or other fastener means 59. In this manner, the roll guide 50 is mounted to the back wall 20 by the connector 57; and by the lateral extension 56 and the dispenser guide portion 52, the storage guide portion 51 is maintained generally centrally of and spaced within the enclosure.

An elongate member, bar or slide 65 is slidable in the passageway 38 of groove 37, extending outwardly therefrom through the open passageway end at the right in FIG. 2. The elongate member or slide 65 may have its inner end doubled or bent upon itself, as at 66, to define a limiting abutment as will appear presently. The outer end of the slide 65 may be bent transversely, as at 67, to extend generally into the open end of the enclosure or housing 12. Thus, the transverse bar portion 67 may be generally normal to the slide member 65. Further, the terminal end portion 68 of the transverse bar portion 67 may be bent to extend obliquely and define an acute angle with the transverse portion 67.

Carried by the transverse portion 67 of slide member 65 may be an end wall or closure 70, shown in solid lines as in closing relation with the right end of the enclosure 12. The end wall 70 may have a through slot 71 for receiving the free end 53 of the roll guide 50. Spaced inward from the free end 53 of the roll guide 50, there may be formed in the roll guide a slot 72. A key lock 73 may be mounted on the inner side of the end wall 70 with a key slot 74 exposed exteriorly of the end wall. The key lock 73 may include a shiftable bolt 75 extendable through the slot 72 of roll guide 50, and retractable therefrom. Thus, in the solid line position of FIG. 2, the roll guide 50 interfits with the end wall 70 by engagement of the guide end 53 through end wall slot 71, and engagement of lock bolt 75 through roll guide 72.

Upon retraction of lock bolt 75 out of its engagement through roll guide slot 72, as upon actuation by a key from exteriorally of the end wall 70, the end wall, with its supporting slide member 65 is shiftable outwardly away from the right end of the enclosure 12, to the dashed outline position shown in FIG. 2. The end wall 70 may be shifted further from the enclosure 12 to facilitate entry of toilet papers rolls 13 and 14 through the right, receiving end of the enclosure as seen in FIG. 2.

Limiting outward or opening movement of end wall 70 is a fixed abuttment or bridging member 80 secured to the back wall 20 extending in bridging relation across the groove 37. The bridging member 80 is suitably secured, as by welding or otherwise, to the exterior surface of the back wall 20, between the latter and the building wall 11, extending across the groove 37 adjacent to the rightward end thereof, as seen in FIG. 2. Further, the medial region of the bridging member 80 may be thickened as at 81, to protrude into the passageway 38 of groove 37, so as to extend into the path of movement of lug 66 upon outward extension of slide member 65. Thus, the bridging member 80 and lug 66 combine to define limiting abutment or retaining means to limit outward extension of the slide member 65 at opening movement of the end wall 70. Upon closing movement of the end wall 70, the oblique terminal portion 68 defines a guide for entry of toilet paper roll guide end 53 into slot 71, to the solid line position shown in FIG. 2.

In order to conserve space, the enclosure 12 is sized to oblately compress the toilet paper rolls, as shown in FIG. 4. This assures frictional retention of the rolls against inadvertent dislodging from their storage positions, while permitting resilient return to the normally relative round condition upon exit from the left open end of the enclosure to the dispensing portion 52 of the roll guide 50. As best seen in FIG. 1, the dispensing portion 52 of the roll guide has one edge cut away, as at 82, reducing the width of the roll guide and facilitating ease of roll rotation. This may be desired in locations where unnecessarily escessive paper usage is not a problem.

In addition to the mounting fasteners 33 and 34, an additional mounting fastener 83 may extend through the connector portion 57 of roll guide 50, as best seen in FIG. 2. Also, if it is desired to conceal the mounting fasteners 33 and 34, the flanges 25 and 30 may be turned inwardly, and suitable tool access openings provided for mounting. The same assembly may dispense from the right, rather than the left as illustrated, by merely inverting the back wall 20 and its assembled parts relative to the housing 12. That is, the back wall 20 together with the roll guide 50 and slide 56 are inverted to locate the bar portion 55 rightward and the wall 70 leftward.

From the foregoing, it is seen that the present invention provides a toilet paper storage dispenser which is a staunch and sturdy unitary structure, capable of economic manufacture and maintenance, durable and reliable through out a long useful life, and which otherwise fully accomplishes its intended objects.

Although the present invention has been described in some detail by way of illustration and example for purposes of clarity of understanding, it is understood that certain changes and modifications may be made within the spirit of the invention.

What is claimed is:

1. A toilet paper storage dispenser comprising an open ended enclosure having elongate front, back and side walls; the ends of said enclosure being open and defining inlet and outlet ends for respectively receiving and delivering toilet paper rolls; said back wall being adapted for attachment to an upright supporting surface; an elongate toilet paper roll guide disposed longitudinally of and centrally within said enclosure having an outlet end region extending through and beyond the outlet end of said enclosure for extension through toilet paper rolls passing through storage positions in said enclosure to a dispensing position beyond said enclosure outlet end; a lateral extension on the outlet end region of said guide extending toward and secured to said back wall; an inlet end wall extending across the inlet end of said enclosure; slide means slidable relative to said back wall and mounting said inlet end wall for shifting movement away from and toward said enclosure between open and closed positions respectively affording and denying access to the inlet enclosure end; and releasable interfitting means on said inlet end wall and inlet end region of said roll guide movable into and out of interfitting engagement upon closing and opening of said inlet end wall, to effect restraint against movement of said roll guide.

2. A toilet paper storage dispenser according to claim 1, in combination with a connector extending from said lateral extension to said back wall; said connector, lateral extension and guide being defined by an integral length of material.

3. A toilet paper storage dispenser according to claim 1, said slide means comprising way means on said back wall, and a slide slidable on said way means and carrying said inlet end wall for said shifting movement.

4. A toilet paper storage dispenser according to claim 3, said way means comprising an elongate groove formed in said back wall longitudinally of said enclosure, and said slide comprising an elongate slide member slidable in said groove between a retracted position within said groove and an extended position having one end extending from said groove beyond the receiving end of the enclosure, said inlet end wall being fixed to said one end of said slide member.

5. A toilet paper storage dispenser according to claim 3, said interfitting means comprising a releasable lock bolt carried by said inlet end wall and releasably interengagable through said roll guide.

6. A toilet paper storage dispenser according to claim 1, said roll guide having one end free adjacent to said enclosure inlet end, said interfitting means comprising a convergent passageway on said inlet end wall for receiving said roll guide free end on movement of said inlet end wall to its closed position, and bolt means on said inlet wall for withdrawable insertion transversely through said roll guide when the latter is in said passageway.

7. A toilet paper storage dispenser according to claim 1, said enclosure side walls converging toward said front wall, to effectively maintain the upper side wall free of articles at rest.

8. A toilet paper storage dispenser according to claim 1, in combination with visual access means in said enclosure for ascertaining the quantity of rolls in storage.

9. A toilet paper storage dispenser according to claim 1, in combination with manual access means in said enclosure for feeding rolls from said enclosure to said dispensing position.

10. A toilet paper storage dispenser according to claim 4, in combination with fixed limit means in said groove adjacent to said receiving enclosure end, and movable limit means on the inner end of said slide member movable with said slide member into and out of limiting engagement with said fixed limit means to retain said slide member in said groove.

11. A toilet paper storage dispenser according to claim 10, said fixed limit means comprising a bridging member bridging said groove and protruding therein, and said movable limit means comprising a lug on said slide member movable into and out of abutting engagement with said bridging member.

12. A toilet paper storage dispenser according to claim 1, said back wall together with said lateral extension, roll guide, slide means and end wall being invertible relative to said front and side walls to change the hand of said storage dispenser.

* * * * *